United States Patent [19]

Ulrich

[11] 4,142,292

[45] Mar. 6, 1979

[54] CHAIN SAW ADAPTER FOR USE PARTICULARLY FOR TRIMMING HEDGES AND CUTTING BRUSH

[75] Inventor: Ray R. Ulrich, 30 Van Duyn Dr., Trenton, N.J. 08618

[73] Assignee: Ray R. Ulrich, Sr., Trenton, N.J.

[21] Appl. No.: 869,884

[22] Filed: Jan. 16, 1978

[51] Int. Cl.[2] ..... B27B 17/02

[52] U.S. Cl. ..... 30/371; 30/122; 56/291

[58] Field of Search ..... 30/122, 166 H, 371, 30/378, 382; 56/291, 292

[56] References Cited

U.S. PATENT DOCUMENTS

| | | | |
|---|---|---|---|
| 2,642,901 | 6/1953 | Hayden | 30/371 |
| 2,698,034 | 12/1954 | Jakku | 30/371 |
| 2,832,136 | 4/1958 | Trecker | 30/371 |
| 3,808,684 | 5/1974 | Ludwig | 30/371 X |

*Primary Examiner*—Jimmy C. Peters

*Attorney, Agent, or Firm*—Albert Sperry; Frederick A. Zoda; John J. Kane

[57] ABSTRACT

An adapter for use attached to a chain saw for trimming hedges and cutting brush which includes a mounting member adapted to be fixedly secured to a chain saw guide or blade by mounting in the normally available bolt holes at the forward and rearward sections of the guide, the adapter further including a plurality of dividers forming a plurality of dividing channels therebetween in which the individual sticks or hedge members are gathered and compressed for cutting, the dividing channels being formed by dividing surfaces on the adjacent sides of said dividers to facilitate grouping of the hedges, the dividers further including a gathering surface positioned adjacent a stopping surface which is formed by the mounting member such that the gathering surface and the stopping surface are at an acute angle with respect to one another of preferably less than 90° such that as the chain saw teeth pass parallel with respect to the stopping surface the hedge elements will be gathered into the narrow constriction formed between the gathering surface and the stopping surface to thereby be held therein for instant and efficient cutting thereof.

10 Claims, 3 Drawing Figures

CHAIN SAW ADAPTER FOR USE PARTICULARLY FOR TRIMMING HEDGES AND CUTTING BRUSH

BACKGROUND OF THE INVENTION

1. Field Of The Invention

The present invention provides an appliance for securement to any conventionally configured chain saw to allow that chain saw to be utilized in the additional capacity of hedge cutting or brush trimming. Chain saws are inoperable for usage in this application in their standard configuration since as the rotating chain teeth pass adjacent a hedge the flexibly biased twigs and the like will flex away from the chain responsive to the high rotational velocity of the chain. In this respect it will be only possible to cut the hedge were the operator to use one hand to hold the hedge elements to be clipped and use the other hand to hold and squeeze the trigger of the chain saw, which itself is a very dangerous and inefficient type of operation.

Therefore the present adapter provides a simple attachment device for securement to the blade of a chain saw merely by securing of two bolts therethrough which automatically divides the hedge into groups to be cut and continuously cuts the groups with the rotating chain teeth.

2. Description Of The Prior Art

Many devices are presently used for cutting grasses, hedges and brush and the like as shown by U.S. Pat. Nos. 14,445; 845,547; 1,968,408; 2,948,099; 3,656,285 and 3,693,676. None of these patents show an appliance for direct attachment to a chain saw to facilitate the usage of that most currently fashionable homeowner appliance to allow its usage for hedge trimming. Prior art hedge trimmers are of the standard configuration using the back and forth scissors motion which are dangerous and inefficient. These standard hedge trimmers do not provide the high speed operation of the present adapter due to the large amount of leverage creatable by the use of very sharp and very small teeth which are inherent in the usual chain saw cutting teeth.

SUMMARY OF THE INVENTION

An embodiment of the adapter for a chain saw of the present invention which is particularly usable for trimming hedges and cutting brush includes a mounting member which is adapted to be fixedly secured to a chain saw guide. A plurality of dividers preferably integrally connected to the mounting member will operably divide the individual hedge members to be trimmed into groupings and will then gather these groupings into a narrow cutting area to facilitate cutting by the teeth on the chain saw.

To facilitate this gathering the dividers may include a plurality of dividing surfaces therealong which gradually narrow the cross-sectional area of the individual hedge members as the hedge cutter is moved across the hedge. The chain saw teeth will grip the hedge and carry the hedge into an increasingly small area formed by an acute angle between the gathering surface of the divider and the stopping surface of the mounting member to thereby lock the hedges for cutting therein.

The stopping surface is preferably formed as an edge of the mounting member perpendicular to the direction of cutting or the direction of movement of the chain saw during cutting. The divider will include an edge defined as the gathering surface which surface will be at an acute angle preferably less than 90° with respect to the stopping surface. In this manner as the chain hits the hedge members within a particular grouping it will carry these hedges into the acute angle until no more lateral movement is possible and at that point the chain will cut the hedge sticks.

The mounting member may be securible to the chain guide through an attachment means such as a bolt and nut assembly which are patterned on the mounting member to match the standard nose bolt hole and mounting bolt hole in a standard chain guide. The usage with a chain saw guide is facilitated by utilizing two similarly constructed pieces each having a separate mounting member to be positioned on opposite sides of the chain guide and each having mated downwardly extending dividers adapted to be secured together by a securement means such as a bolt and nut assembly adjacent the dividing heads of the individual dividers. With this configuration and with the single mounting member configuration it is desirable to include a clearance channel which is defined by the mounting member of the dividers in the area immediately adjacent to the movement path of the chain and chain teeth to prevent contact between the sharpened chain teeth and the adapter of the present invention.

It is an object of the present invention to provide an adapter for use secured to a chain saw to facilitate trimming hedges and cutting brush therewith.

It is an object of the present invention to provide a chain saw adapter which is simple in construction and easy to install to allow a chain saw to be used for trimming shrubbery.

It is an object of the present invention to provide a chain saw adapter for use particularly for trimming hedges and cutting brush which is efficient and relatively inexpensive.

It is an object of the present invention to provide a chain saw adapter for use particularly for trimming hedges and cutting brush which facilitates the gathering of the individual members of the hedge in a close well-defined area to facilitate snipping thereof by the chain teeth.

It is an object of the present invention to provide a chain saw adapter for use particularly for trimming hedges and cutting brush which divides a hedge into individual hege member groupings to facilitate gathering and holding thereof for cutting.

It is an object of the present invention to provide a chain saw adapter for use particularly for trimming hedges and cutting brush which provides an automatic gathering means defined by an acute angle for securing the individual hedge members momentarily prior to and during cutting thereof.

It is an object of the present invention to provide a chain saw adapter for use particularly for trimming hedges and cutting brush which allows a single operator to perform the operation merely by holding the chain saw and does not require any holding of the brush members themselves individually other than merely causing contact between them and the saw.

It is an object of the present invention to provide a chain saw adapter for use particularly for trimming hedges and cutting brush which is capable of being quickly installed and quickly disassembled immediately prior to and after each individual hedge cutting session.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings in which:

DETAILED DESCRIPTION OF THE PREFERRED EMBODIMENT

Figure 1:
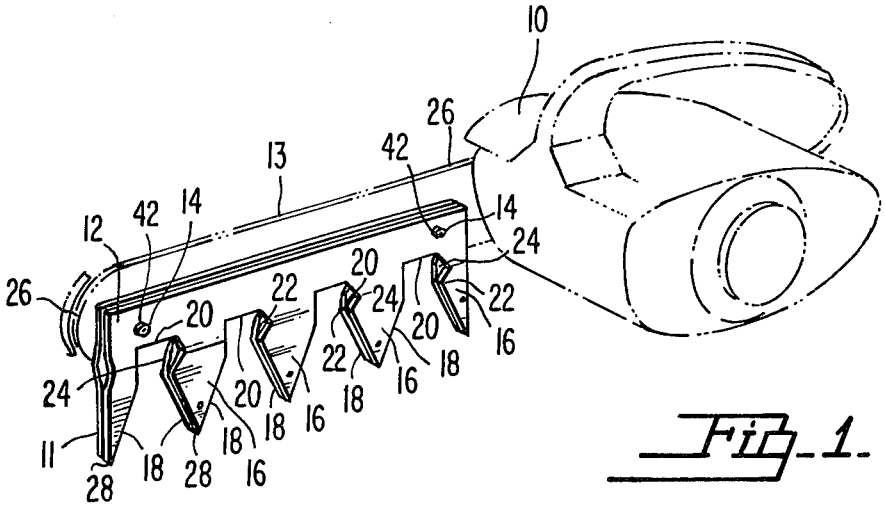
FIG. 1 is a perspective view of a preferred embodiment of the chain saw adapter of the present invention.

In an embodiment of the present invention it is preferred to provide an adapter 11 for usage with a chain saw 10 which includes a mounting member 10 to be secured to the chain guide 13 of the chain saw 10. In order to make this mounting a plurality of mounting apertures are defined within the mounting member 12 which conform approximately to the usual bolt pattern existing within standard chain guides of standard chain saws.

Figure 2:
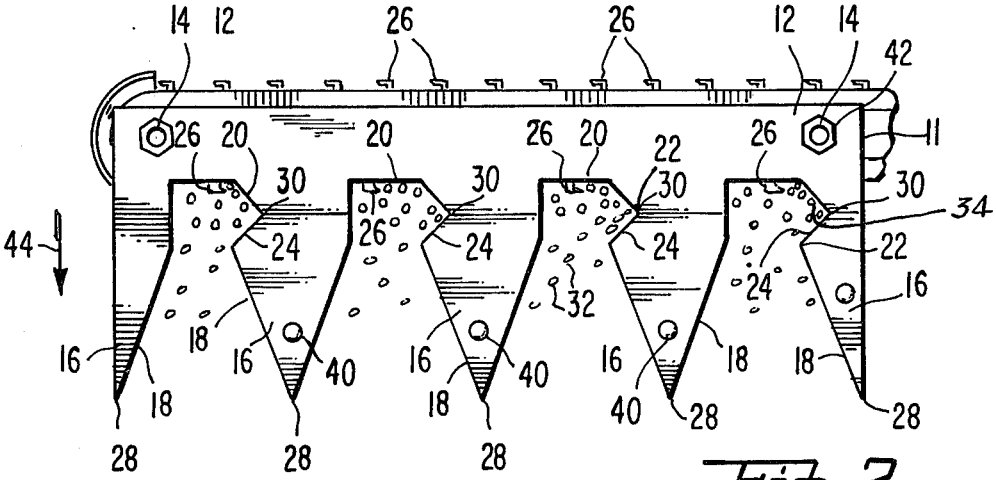
FIG. 2 is a side elevation showing an embodiment of the adapter of the present invention.
Figure 3:
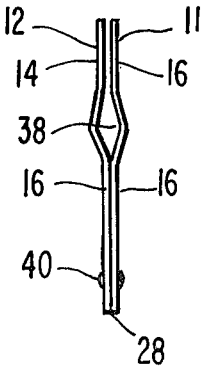
FIG. 3 is a front view of the adapter of the present invention shown in the uninstalled position.

To facilitate the chanelling of hedges and brush for cutting thereof by the teeth on the chain saw 10 a plurality of dividers 16 may be configured integrally with the mounting member 12. These dividers 16 include a plurality of dividing surfaces 18 thereon and as shown in FIG. 2 preferably two dividing surfaces per divider 16. These dividing surfaces may include an apex point 22 which notes the change over from a dividing surface to a gathering surface 24. The gathering surface 24 is configured complementary with a stopping means 20 which is defined as an edge of the mounting member 12.

The edge defined as the gathering surface 24 should provide an acute angle with respect to the stopping surface 30 to thereby aid in the gathering of hedge members for clipping. The chain teeth 26 will aid in guiding and urging the hedge elements into the acute angle to compress the hedge members together immediately prior to and during cutting thereof.

The dividers may include a plurality of dividing heads 28 which are particularly useful in initially dividing the individual hedge members 32 into hedge member groupings 34. Each hedge member grouping will be created within a dividing channel 36 which is defined by the area in between adjacent dividers 16.

It is preferable to form the adapter 12 having two mounting members 12, one being located on each side of the guide 13. With this configuration a matching set of dividers 16 will be positioned protruding from each mounting member 12 and will be secured together by securement means at the lower edge thereof near the dividing heads 28. With this configuration and with the single mounting member 12 configuration a problem arises in order to prevent the contact being made from the high speed traveling chain and chain teeth with the adapter structure. To eliminate such contact a clearance means 38 may be included to assure that a completely open clearance channel is provided to eliminate breakage or damage to the chain teeth and/or damage to the adapter 11. The mounting member should be secured to the chain guide by an attachment means such as a bolt and nut 42 and in the double configuration the divider heads 28 are secured to one another by a securement means such as nut and bolt assembly 40.

In operation the adapter 11 when positioned on a chain saw 10 will be moved in the direction as shown by cutting direction arrow 44. The individual hedge members are shown in FIG. 2 and as the chain saw adapter is moved in the direction of arrow 44 with respect thereto the individual hedge members are gradually moved toward the stopping surfaces 20. As soon as an individual hedge member passes the dividing head 28 the dividing surfaces 18 will start to separate the hedge members 32 into hedge member groupings 34 whereby one such grouping will be present within each dividing channel 36 defined between adjacent dividers 16. As the assembly is moved further in the direction of arrow 44 the hedge groupings will be more and more compressed until they pass the apex point 22 at which point the gathering surface will start to gather the individual hedge members within the cutting area in the form of an acute angle 30 which is formed by the gathering surface 24 and the stopping surface 20. As the chain saw teeth contact the individual hedge members they will be resiliently urged into the acute angle and carried therein and further compressed and condensed such that a number of the individual hedge elements will always be present in the point of the angle in order to allow the chain saw teeth to clip the hedge. This gathering system is an automatic result of the configuration of surfaces of the adapter 11 of the present invention. The teeth of the chain saw not only gather the hedges for cutting but also do the cutting and in that manner perform the two vital functions which are critical when cutting such loosely oriented resilient members as hedges and brush members.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A chain saw adapter for use particularly for trimming hedges and cutting brush which comprises:

(a) a mounting member adapted to be fixedly secured to a chain saw chain guide; and (b) a plurality of dividers fixedly secured to said mounting member to operably divide the individual members of the hedge to be trimmed into hedge member groupings as the adapter passes therethrough, said mounting member further including a stopping surface adjacent the path of movement of the chain teeth and between said dividers, said dividers and said stopping surface defining dividing channels therebetween to receive the individual hedge member groupings therein for cutting, said dividers including:

(1) dividing surfaces for guiding the hedge members into hedge member groupings within each said dividing channel; and (2) gathering surfaces oriented at an oblique angle with respect to the movement direction of the chain teeth, said gathering surfaces defining a cutting zone by forming an acute angle with respect to the stopping surface positioned thereadjacent.

2. The adapter as defined in claim 1 wherein said dividing surfaces of said dividers are at an oblique angle with respect to one another to narrow the lateral width of said dividing channel to compress the individual hedge members against one another.

3. The adapter as defined in claim 1 wherein said dividers further include an apex point on one side thereof formed by the back end of one of said dividing surfaces and the front end of one of said gathering surfaces.

4. The adapter as defined in claim 1 wherein said gathering surfaces and said stopping surfaces are at an angle with respect to one another of less than 90° to define a cutting zone therebetween past which the chain teeth pass to effectively cut the hedge elements which have been gathered within said cutting zone.

5. The adapter as defined in claim 1 wherein said mounting member defines mounting apertures therein to facilitate securement of the adapter to the chain guide of a chain saw.

6. The adapter as defined in claim 1 wherein said dividers are integrally formed as one unit with said mounting member.

7. The adapter as defined in claim 1 further including dividing heads at the forwardmost point of said dividers to facilitate separating of the hedge members into groupings for cutting.

8. The adapter as defined in claim 1 wherein the adapter includes two of said mounting members and two sets of said plurality of dividers, each adapter assembly being affixed to opposite sides of the chain saw guide.

9. The adapter as defined in claim 1 further including a clearance channel defined adjacent the chain teeth path by the sections of said mounting member and said dividers to provide clearance to allow the chain cutting teeth to travel therepast.

10. A chain saw adapter for use particularly for trimming hedges and cutting brush which comprises:

(a) a mounting member adapted to be fixedly secured to a chain saw guide chain;

(b) a plurality of dividers integral with respect to said mounting member to operably divide the individual members of the hedge to be trimmed into hedge member groupings as the passes therethrough, said mounting member further including a stopping surface adjacent the path of movement of the chain teeth and between said dividers, said dividers and said stopping surface defining dividing channels therebetween to receiver the individual hedge member groupings therein for cutting, each of said dividers including;

(1) two dividing surfaces for guiding the hedge members into hedge member groupings within each said dividing channel, adjacent dividing surfaces being at oblique angles with respect to one another to narrow the lateral width of said dividing channel to compress the individual hedge elements into a narrower cross-sectional area to facilitate cutting thereof by the teeth of the chain;

(2) a gathering surface oriented at an oblique angle with respect to the movement direction of the chain teeth, said gathering surface defining a cutting zone by forming an acute angle with respect to said stopping surface positioned thereadjacent; and (3) an apex point formed at the forward edge of said dividers adjacent each of said dividing surfaces to facilitate the initial separations of the hedge members into adjacent dividing channels; and (c) a clearance channel defined adjacent the chain teeth path by the sections of said mounting member and said divider to provide clearance to allow the chain cutting teeth to travel therepast.

* * * * *